US010901352B2

(12) United States Patent
Sakurai

(10) Patent No.: US 10,901,352 B2
(45) Date of Patent: Jan. 26, 2021

(54) HEATING UNIT INSERTABLE THROUGH AN OPEN END OF A HOLLOW PORTION, DRIVING-FORCE TRANSMISSION UNIT AND BEARING PORTION

(71) Applicant: FUJI XEROX CO., LTD., Tokyo (JP)

(72) Inventor: Yusuke Sakurai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/398,284

(22) Filed: Apr. 30, 2019

(65) Prior Publication Data

US 2020/0192258 A1 Jun. 18, 2020

(30) Foreign Application Priority Data

Dec. 14, 2018 (JP) ..... 2018-234184

(51) Int. Cl.
*G03G 15/20* (2006.01)
*G03G 21/16* (2006.01)

(52) U.S. Cl.
CPC ..... *G03G 15/2053* (2013.01); *G03G 15/2007* (2013.01); *G03G 15/2064* (2013.01); *G03G 21/1685* (2013.01); *G03G 15/2017* (2013.01); *G03G 2221/1639* (2013.01)

(58) Field of Classification Search
CPC ..... G03G 15/2007; G03G 15/2017; G03G 15/2053; G03G 15/2064; G03G 21/1685; G03G 2221/1639; G03G 2221/1657
See application file for complete search history.

(56) References Cited

U.S. PATENT DOCUMENTS

2006/0140690 A1* 6/2006 Ito ..... G03G 15/2053 399/330
2015/0093167 A1* 4/2015 Hazeyama ..... G03G 15/2053 399/329

FOREIGN PATENT DOCUMENTS

JP 2005-257902 9/2005
JP 2017-227751 12/2017

* cited by examiner

*Primary Examiner* — Joseph S Wong
(74) *Attorney, Agent, or Firm* — JCIPRNET

(57) ABSTRACT

A heating device includes a hollow portion that has an endless loop shape in a rotation direction and that has open ends in a rotation-axis direction, at least one heating unit that includes a heat-generating portion and that is inserted in the hollow portion, the heating unit being configured to heat the hollow portion from a space enclosed by the hollow portion as a result of heat generation of the heat-generating portion, and a driving-force transmission unit that is fixed to an end portion of the hollow portion in the rotation-axis direction and that transmits a driving force, which is transmitted to the driving-force transmission unit by a driving source, to the hollow portion so as to rotate the hollow portion, the driving-force transmission unit having an opening that is in communication with an interior of the hollow portion. The heat-generating portion is disposed at a position that does not overlap the driving-force transmission unit in the rotation-axis direction.

11 Claims, 6 Drawing Sheets

HEATING UNIT INSERTABLE THROUGH AN OPEN END OF A HOLLOW PORTION, DRIVING-FORCE TRANSMISSION UNIT AND BEARING PORTION

CROSS-REFERENCE TO RELATED APPLICATIONS

This application is based on and claims priority under 35 USC 119 from Japanese Patent Application No. 2018-234184 filed Dec. 14, 2018.

BACKGROUND

(i) Technical Field

The present disclosure relates to a heating device, a fixing device, and an image forming apparatus.

(ii) Related Art

There is a device that heats, while rotating, a member to be heated. Here, a fixing device will be described as an example. A fixing device that will now be described as an example is a device including a pair of fixing units that nip a sheet, which has been transported while holding a toner image, therebetween and fixes the toner image onto the sheet by applying heat and pressure to the sheet while rotating. In the fixing device, when a driving-force transmission unit, such as a gear, that transmits a rotational driving force to the fixing units generates heat, there is a possibility that the driving-force transmission unit will deform, and thus, an issue that concerns the fixing device and that is to be addressed is to suppress heat generation of the driving-force transmission unit.

Here, Japanese Unexamined Patent Application Publication No. 2005-257902 discloses that energization of a heating lamp is controlled in accordance with the temperature measured by a temperature sensor, so that an excessive temperature rise of a fixing unit is suppressed.

Japanese Unexamined Patent Application Publication No. 2017-227751 discloses that heat shielding portions are provided in the vicinity of the two ends of a heating lamp that is built in a fixing unit, the two ends being out of an area through which a sheet passes.

Such an issue to be addressed, which is to suppress heat generation of a driving-force transmission unit, such as a gear, that transmits a rotational driving force is not limited to concerning a fixing device and is common to heating devices each of which includes a heating unit disposed therein and that is driven so as to rotate.

SUMMARY

Aspects of non-limiting embodiments of the present disclosure relate to providing a heating device, a fixing device, and an image forming apparatus capable of suppressing heat generation of a driving-force transmission unit compared with the configuration in which a heating unit includes a heat-generating portion disposed at a position that overlaps the driving-force transmission unit in a rotation-axis direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a heating device including a hollow portion that has an endless loop shape in a rotation direction and that has open ends in a rotation-axis direction, at least one heating unit that includes a heat-generating portion and that is inserted in the hollow portion, the heating unit being configured to heat the hollow portion from a space enclosed by the hollow portion as a result of heat generation of the heat-generating portion, and a driving-force transmission unit that is fixed to an end portion of the hollow portion in the rotation-axis direction and that transmits a driving force, which is transmitted to the driving-force transmission unit by a driving source, to the hollow portion so as to rotate the hollow portion, the driving-force transmission unit having an opening that is in communication with an interior of the hollow portion. The heat-generating portion is disposed at a position that does not overlap the driving-force transmission unit in the rotation-axis direction.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the drawings.

Figure 1:
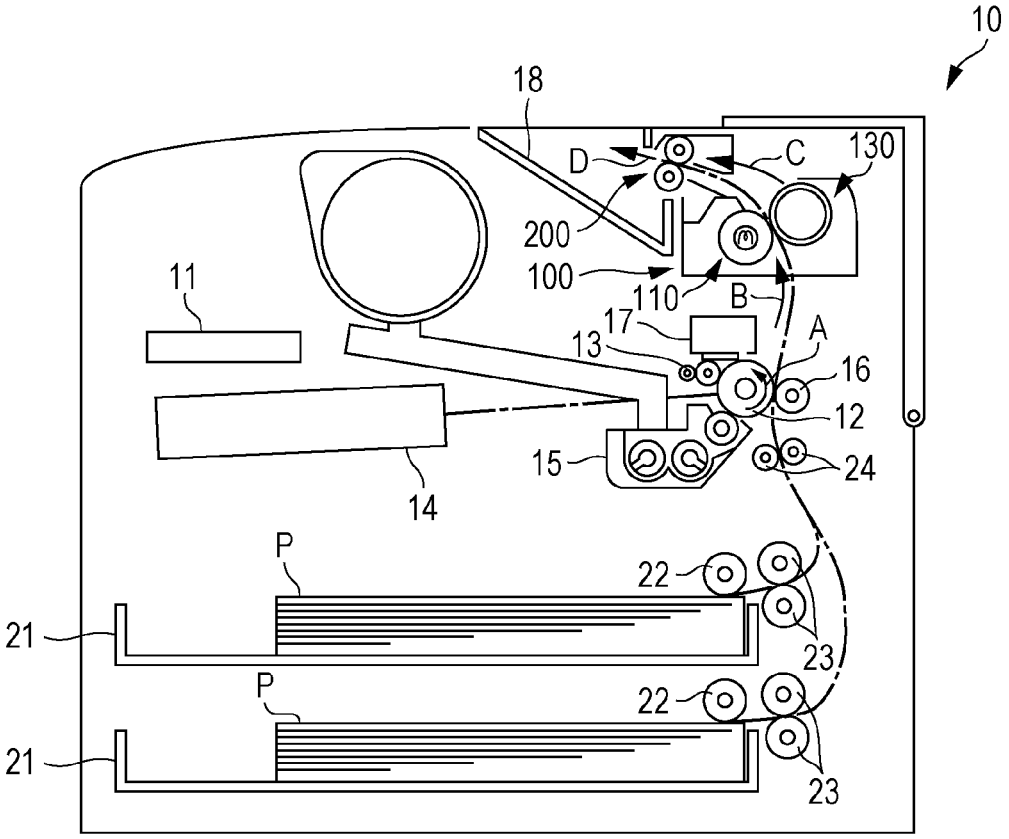
FIG. 1 is a schematic diagram of a printer that is an exemplary embodiment of an image forming apparatus of the present disclosure.

FIG. 1 is a schematic diagram of a printer that is an exemplary embodiment of an image forming apparatus of the present disclosure.

A printer 10 illustrated in FIG. 1 is a black-and-white printer, and a device that is an exemplary embodiment of a heating device of the present disclosure and a device that is an exemplary embodiment of a fixing device of the present disclosure are incorporated within the printer 10.

An image signal that is formed outside the printer 10 and that represents an image is to be input to the printer 10 via a signal cable or the like (not illustrated). The printer 10 includes a controller 11 that controls the operation of each component included in the printer 10, and the image signal is input to the controller 11. The printer 10 performs image formation based on the image signal under control of the controller 11.

The printer 10 includes two sheet trays 21 that are disposed in a lower portion of the printer 10, and sheets P are stacked on top of one another in each of the sheet trays 21. The sheet trays 21 are configured to be capable of being drawn out so as to be supplied with the sheets P.

The sheets P in one of the two sheet trays 21, the sheet tray 21 being used for this image formation, are taken out by a pickup roller 22, and one of the sheets P is separated from the rest of sheets P by separation rollers 23 and sent to standby rollers 24. The sheet P, which has reached the standby rollers 24, is further transported by adjusting the timing of transportation of the sheet P.

The printer 10 includes a photoconductor 12 that rotates in the direction of arrow A and that is disposed above the standby rollers 24. In addition, a charger 13, an exposure unit 14, a developing unit 15, a transfer unit 16, and a photoconductor cleaner 17 are arranged around the photoconductor 12.

The charger 13 charges a surface of the photoconductor 12, and the exposure unit 14 exposes the surface of the photoconductor 12 to light in such a manner as to form an electrostatic latent image onto the photoconductor 12. The electrostatic latent image is developed by the developing unit 15, so that, a toner image is formed onto the photoconductor 12.

Here, the above-mentioned standby rollers 24 send out the sheet P in such a manner that the sheet P reaches a position facing the transfer unit 16 in accordance with the timing at which the toner image on the photoconductor 12 reaches the position. Then, the toner image on the photoconductor 12 is transferred onto the sheet P, which has been sent out, by operation of the transfer unit 16.

Toner that remains on the photoconductor 12 after the toner image has been transferred is removed from the photoconductor 12 by the photoconductor cleaner 17.

The sheet P, to which the toner image has been transferred, is further transported in the direction of arrow B, and the toner image is fixed onto the sheet P by being heated and pressurized by a fixing unit 100. As a result, an image that is formed of the fixed toner image is formed onto the sheet P. The fixing unit 100 corresponds to an exemplary embodiment of a fixing device of the present disclosure.

The sheet P, which has passed through the fixing unit 100, is transported in the direction of arrow C toward an ejecting unit 200. Then, the sheet P is further transported by the ejecting unit 200 in the direction of arrow D and ejected to a sheet-ejection tray 18.

Figure 2:
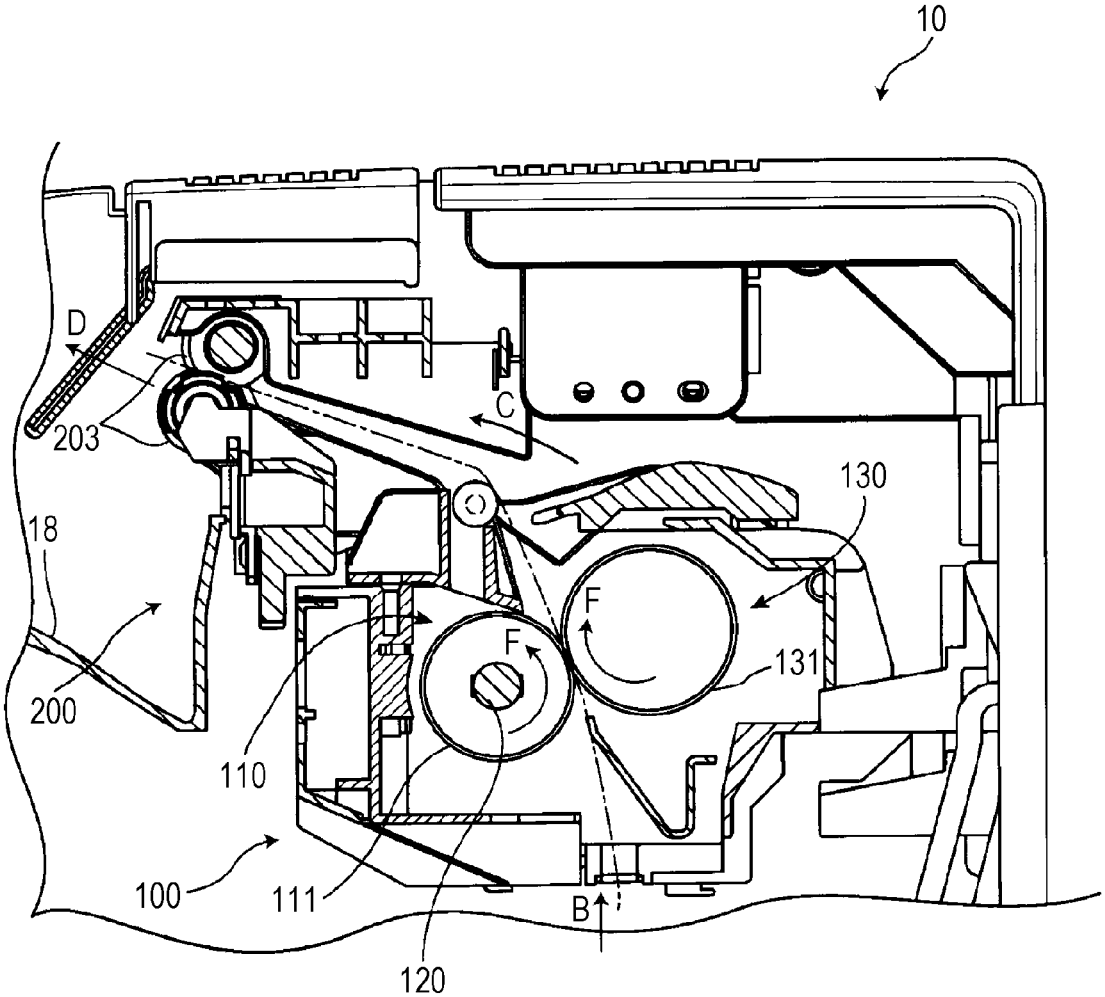
FIG. 2 is a diagram illustrating a cross-sectional view of a fixing unit and an ejecting unit that are included in the printer, which is illustrated in FIG. 1.

FIG. 2 is a diagram illustrating a cross-sectional view of the fixing unit and the ejecting unit that are included in the printer 10, which is illustrated in FIG. 1.

The fixing unit 100 includes a heating unit 110 and a pressing unit 130. The heating unit 110 corresponds to an example of one of a pair of fixing units according to an exemplary embodiment of the present disclosure, and the pressing unit 130 corresponds to an example of the other of the pair of fixing units. In addition, the heating unit 110 corresponds to an exemplary embodiment of the heating device of the present disclosure.

The heating unit 110 includes a heating roller 111. The heating roller 111 is a metal hollow cylinder that has an outer peripheral surface coated with a release material, and a halogen lamp 120 that is disposed within the heating roller 111 and that is a heat source. Here, the heating roller 111 corresponds to an example of a hollow portion according to an exemplary embodiment of the present disclosure, and the halogen lamp 120 corresponds to an example of a heating unit according to an exemplary embodiment of the present disclosure.

The pressing unit 130 includes a pressure roller 131. The pressure roller 131 also has a cylindrical shape, and the circumferential surface of the pressure roller 131 is pressed against the circumferential surface of the heating roller 111. The sheet P, which has reached the fixing unit 100 by being transported in the direction of arrow B, enters a contact portion where the pressure roller 131 and the heating roller 111 are in contact with each other. The sheet P is nipped between the heating roller 111 and the pressure roller 131 at the contact portion. In this case, a surface of the sheet P on which the toner image has been formed faces the heating roller 111.

The heating roller 111 and the pressure roller 131 rotate in the direction of arrow F while being in contact with each other. Thus, the sheet P that enters the contact portion is caused to pass through the contact portion and to be transported in the direction of arrow C toward the ejecting unit 200 as a result of rotation of the heating roller 111 and rotation of the pressure roller 131. When the sheet P passes through the contact portion, the sheet P is heated by the halogen lamp 120 disposed in the heating roller 111 and pressurized by the pressure roller 131, so that the toner image is fixed onto the sheet P, so that an image that is formed of the fixed toner image is formed onto the sheet P. The sheet P is sent out from the ejecting unit 200 in the direction of arrow D and ejected to the sheet-ejection tray 18 by sheet-ejection rollers 203.

Details of the heating unit 110 will now be described. Here, the heating roller 111 will be described first.

Figure 3:
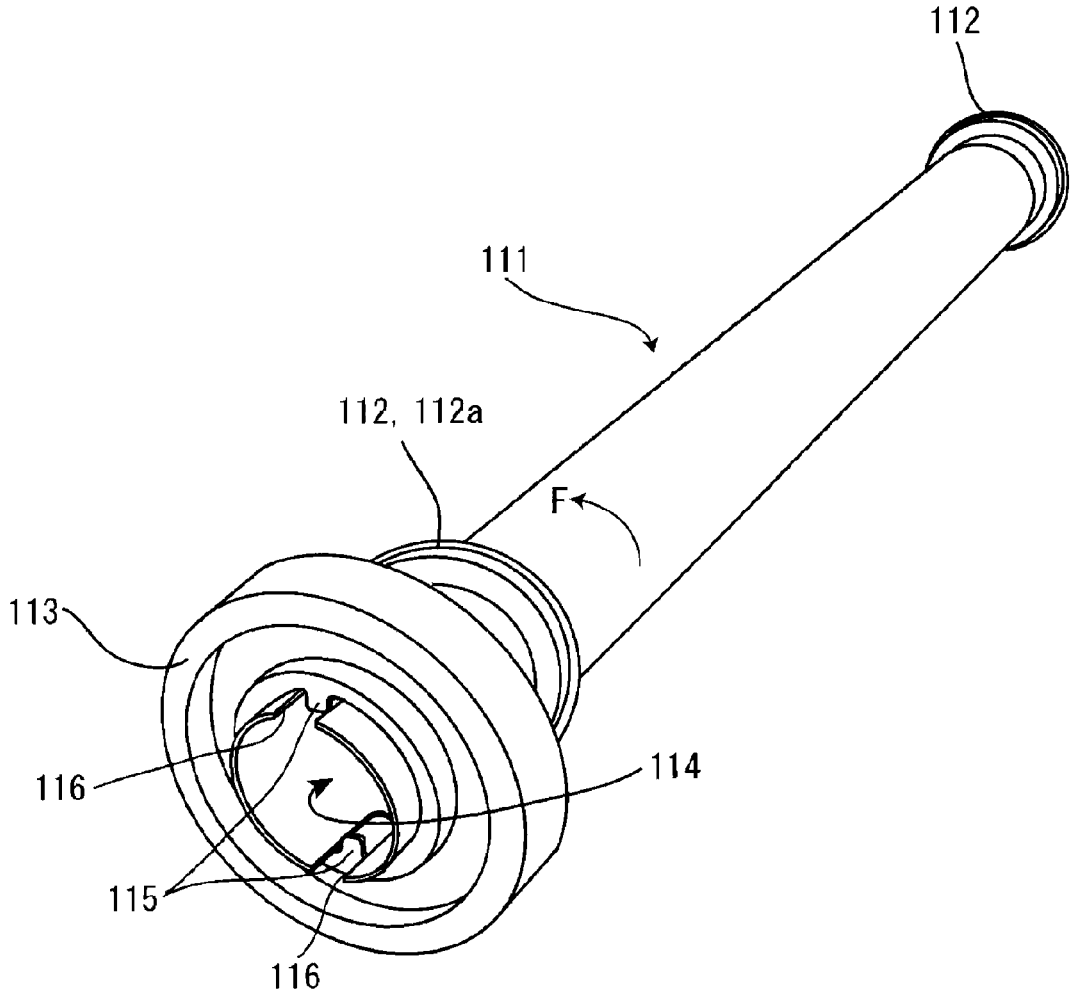
FIG. 3 is a perspective view of a heating roller.

FIG. 3 is a perspective view of the heating roller.

Bearings 112 are attached at the two end portions of the heating roller 111. The heating roller 111 is rotatably fixed to a frame, which is not illustrated, with these bearings 112 interposed therebetween. Each of the bearings 112 corresponds to an example of a bearing portion according to an exemplary embodiment of the present disclosure. A drive gear 113 that is made of a resin and that drives the heating roller 111 so that the heating roller 111 rotates is disposed in such a manner as to be closer to one of the end portions of the heating roller ill than a bearing 112*a*, which is one of the bearings 112, is. The drive gear 113 has a through hole 114 that communicates with the interior of the heating roller 111, which is a cylinder. The drive gear 113 has teeth (not illustrated) that are arranged on a peripheral surface thereof and receives a driving force from a motor through the teeth. The drive gear 113 further includes keys 115 each of which projects inward, and these keys 115 are fitted into key grooves 116 each of which is formed at one of the end portions of the heating roller 111. The drive gear 113 receives a driving force from the motor (not illustrated) and transmits the driving force to the heating roller 111. The heating roller 111 rotates in the direction of arrow F illustrated in FIG. 3 by the driving force. The drive gear 113 corresponds to an example of a driving-force transmission unit according to an exemplary embodiment of the present disclosure.

The configuration of the heating unit 110 including the halogen lamp 120 will now be described.

Figure 4:
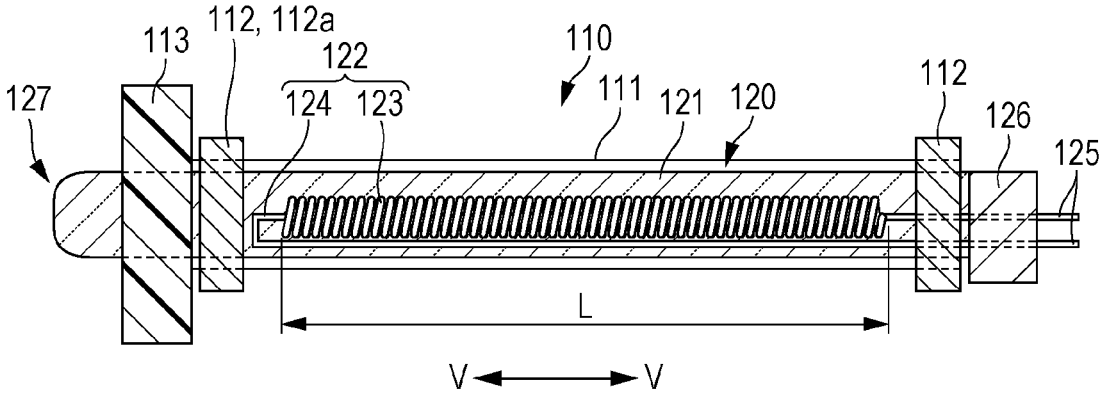
FIG. 4 is a schematic diagram illustrating a heating unit.

FIG. 4 is a schematic diagram illustrating the heating unit. In FIG. 4, for ease of understanding, the heating roller 111 is indicated by using only a frame line, and a filament of the halogen lamp 120 is indicated by a solid line. Also for ease of understanding, here, the entire halogen lamp 120 is illustrated by hatching.

The halogen lamp 120 includes a glass tube 121 in which an inert gas is sealed and a filament 122 that is incorporated in the glass tube 121. The halogen lamp 120 further includes a base 126 that is disposed at an end of the glass tube 121 and that holds terminals 125 used for supplying power to the filament 122. In the halogen lamp 120, the base 126 and a head portion 127 of the glass tube 121 are fixed to the frame (not illustrated) so as not to be rotatable. Thus, when the driving force is transmitted to the heating roller 111 via the drive gear 113, the heating roller 111 rotates while the halogen lamp 120 is fixed in place so as not to be rotatable.

Here, the filament 122 includes a heat-generating portion 123 that is wound in a helical manner and a current-carrying portion 124 that carries power to the heat-generating portion 123. Although the heat-generating portion 123 and the current-carrying portion 124 are made of the same material, the amount of heat generated by the heat-generating portion 123 per unit length is much larger than the amount of heat generated by the current-carrying portion 124 per unit length because the heat-generating portion 123 is wound. In the case illustrated in FIG. 4, the heat-generating portion 123 is wound and extends to have a length L. However, the heat-generating portion 123 is disposed at a position that does not overlap the drive gear 113 in rotation-axis directions indicated by arrows V-V. In addition, in the case illustrated in FIG. 4, the heat-generating portion 123 is disposed at the position that also does not overlap the bearings 112 in the rotation-axis directions. The heat-generating portion 123 corresponds to an example of a heat generating portion according to an exemplary embodiment of the present disclosure.

Figure 5A:
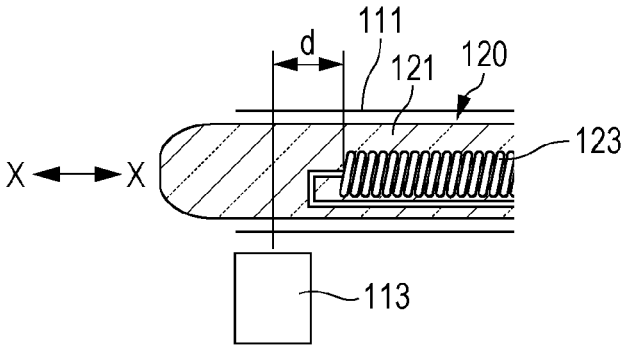
FIGS. 5A and 5B are diagrams each illustrating experimental data.
Figure 5B:
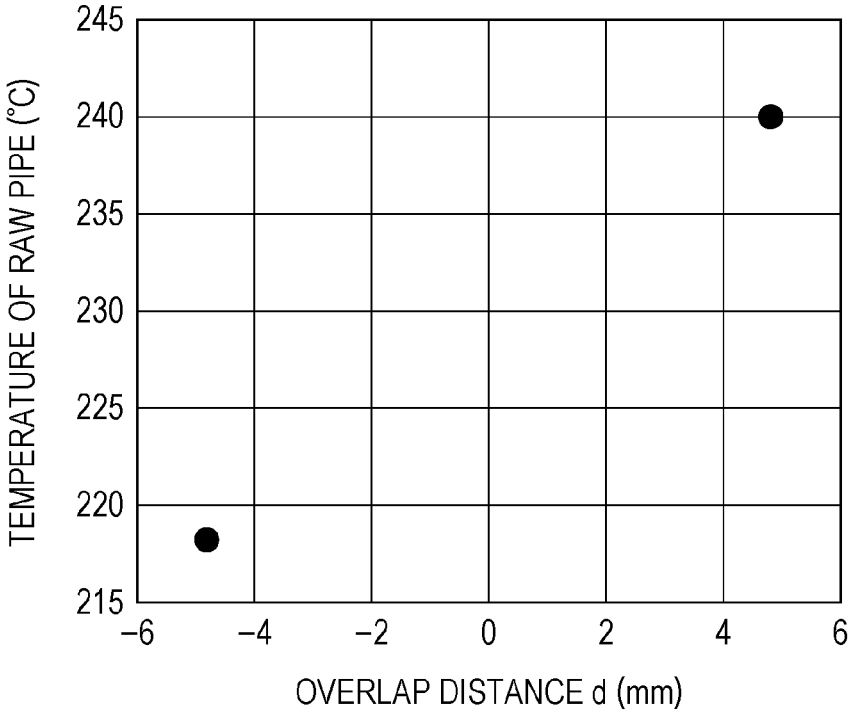

FIGS. 5A and 5B are diagrams each illustrating experimental data.

Here, as illustrated in FIG. 5A, the heating roller 111 becomes a raw pipe by removing the drive gear 113 and so forth from the heating roller 111, and the halogen lamp 120 is moved in directions indicated by arrows X-X in such a manner as to adjust a distance d illustrated in FIG. 5A. The distance d is a distance (an overlap distance d) between a portion of the heating roller 111 (in a state of a raw pipe) to which the drive gear 113 is to be fixed and an end of the heat-generating portion 123 of the filament 122. Then, the temperature of the portion of the heating roller 111 (in a state of a raw pipe) to which the drive gear 113 is to be fixed is measured.

FIG. 5B illustrates results of the above measurement. In FIG. 5B, the horizontal axis denotes the overlap distance d (mm), and the vertical axis denotes temperature (° C.). When the value of the overlap distance d is negative, the portion of the heating roller 111 to which the drive gear 113 is to be fixed and the end of the heat-generating portion 123 do not overlap each other as illustrated in FIG. 5A, and the negative value indicates the distance between the portion of the heating roller 111 and the end of the heat-generating portion 123. In other words, FIG. 5A illustrates the negative value of the overlap distance d.

As illustrated in FIG. 5B, it is understood that the temperature of the raw pipe is low when the value of the overlap distance d is negative.

FIG. 4 will be referred to again in the following description.

The drive gear 113 according to the present exemplary embodiment is made of a resin, and there is a possibility that the drive gear 113 will deform when the temperature thereof becomes excessively high. Alternatively, even in the case where the drive gear 113 is made of a metal, there is a possibility that transmission of the driving force will not be smoothly performed as a result of thermal expansion. In the exemplary embodiment illustrated in FIG. 4, the heat-generating portion 123 is disposed at the position that does not overlap the drive gear 113 in the rotation-axis directions indicated by arrows V-V. This prevents the drive gear 113 from being excessively heated to a high temperature.

In addition, in the case illustrated in FIG. 4, the heat-generating portion 123 is disposed at the position that also does not overlap the bearings 112 in the rotation-axis directions. When the temperature of each of the bearings 112 becomes excessively high, there is possibility that smooth rotation of the heating roller 111 will be hindered by thermal deformation of the bearing 112. In the exemplary embodiment illustrated in FIG. 4, by disposing the heat-generating portion 123 at the position that also does not overlap the bearings 112 in the rotation-axis directions, each of the bearings 112 is prevented from being excessively heated to a high temperature.

Figure 6:
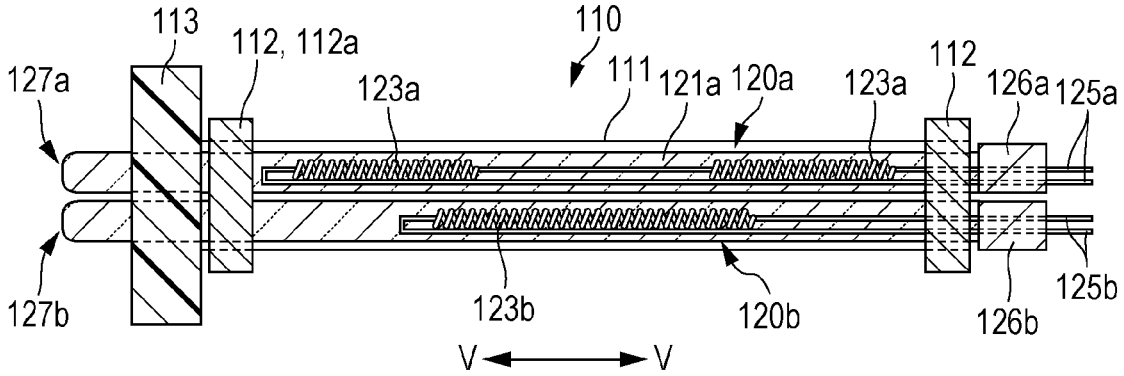
FIG. 6 is a schematic diagram illustrating a heating unit according to another exemplary embodiment.

FIG. 6 is a schematic diagram illustrating a heating unit according to another exemplary embodiment. Similar to FIG. 4, in FIG. 6, the heating roller 111 is indicated by using only a frame line, and halogen lamps 120*a* and 120*b* are illustrated by hatching.

In the case illustrated in FIG. 6, the two halogen lamps 120*a* and 120*b* are disposed within the heating roller 111. Components of the halogen lamps 120*a* and 120*b* are denoted by reference signs each of which is obtained by adding the reference character "a" or "b" to a corresponding one of the reference signs illustrated in FIG. 4.

The halogen lamp 120*a*, which is one of the two halogen lamps 120*a* and 120*b*, includes heat-generating portions 123*a* that are arranged at two positions that are close to the two ends of the heating roller 111. The halogen lamp 120*a* is in charge of heating portions of the heating roller 111 that are close to the ends of the heating roller 111. In contrast, the other halogen lamp 120*b* includes a heat-generating portion 123*b* that is disposed at the center of the heating roller 111. The halogen lamp 120*b* is in charge of heating a center portion of the heating roller 111. The heating roller 111 is a hollow cylinder having open ends. Thus, heat easily escapes from the two ends of the heating roller 111. In the case illustrated in FIG. 6, the two halogen lamps 120*a* and 120*b*, which are illustrated in FIG. 6, are provided, and power is supplied separately to these two halogen lamps 120*a* and 120*b*, so that the balance between the temperature of the center portion of the heating roller 111 and the temperatures of the portions of the heating roller 111 close to the two ends of the heating roller 111 is controlled.

Here, in the case illustrated in FIG. 6, the heat-generating portions 123*a* and 123*b* of the both two halogen lamps 120*a* and 120*b* are each disposed at a position that overlaps none of the drive gear 113 and the bearings 112 in the rotation-axis directions indicated by arrows V-V.

Note that, although the halogen lamps have been described as examples of the heating unit according to the exemplary embodiment of the present disclosure, and the portions at which the filaments are wound have been described as examples of the heat-generating portion according to the exemplary embodiment of the present disclosure, the heating unit according to the exemplary embodiment of the present disclosure is not limited to a halogen lamp, and it is only necessary that the heating unit be disposed in a space enclosed by a hollow portion such as a heating roller in such a manner as to heat the hollow portion from the space enclosed by the hollow portion as a result of the heat-generating portion generating heat.

In addition, although a case has been described in which the heating device, which is an example of the present disclosure, is applied to the fixing unit 100 of the printer 10, which is illustrated in FIG. 1, the heating device according to the exemplary embodiment of the present disclosure may be widely applied to devices that require a configuration in which a hollow portion that rotates is heated from a space enclosed by the hollow portion.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A heating device comprising:

a hollow portion that has an endless loop shape in a rotation direction and that has open ends in a rotation-axis direction;

at least one heating unit that includes a heat-generating portion and that is inserted in the hollow portion, the heating unit being configured to heat the hollow portion from a space enclosed by the hollow portion as a result of heat generation of the heat-generating portion;

a driving-force transmission unit that is fixed to a first end portion of the hollow portion in the rotation-axis direction and that transmits a driving force, which is transmitted to the driving-force transmission unit by a driving source, to the hollow portion so as to rotate the hollow portion, the driving-force transmission unit having an opening that is in communication with an interior of the hollow portion; and a plurality of bearing portions that are on opposite ends of the hollow portion in a longitudinal direction of the hollow portion, wherein the heat-generating portion is disposed at a position that does not overlap the plurality of bearing portions in a radial direction of the hollow portion.

2. The heating device according to claim 1, wherein the at least one heating unit, which is inserted in the hollow portion, includes a plurality of heating units, and wherein each of the heating units includes the heat-generating portion disposed at a position that does not overlap the driving-force transmission unit in the rotation axis radial direction.

3. The heating device according to claim 2, wherein each of the heating units includes the heat-generating portion disposed at a position that also does not overlap the plurality of bearing portions in the radial direction.

4. The heating device according to claim 1, wherein the heating unit is a halogen lamp including a filament that has the heat-generating portion wound in a helical manner.

5. The heating device according to claim 2, wherein each of the heating units is a halogen lamp including a filament that has the heat-generating portion wound in a helical manner.

6. The heating device according to claim 3, wherein each of the heating units is a halogen lamp including a filament that has the heat-generating portion wound in a helical manner.

7. A fixing device comprising:

a pair of fixing units that nip a sheet, which has been transported while holding a toner image, between the pair of fixing units and fixes the toner image onto the sheet by applying heat and pressure to the sheet, wherein the heating device according to claim 1 is incorporated in one of the pair of fixing units.

8. An image forming apparatus comprising:

an image forming unit that forms a toner image onto a sheet; and the fixing device according to claim 7.

9. The heating device according to claim 4, wherein the filament has a bending portion, and two end portions of the filament are connected to terminals at a second end portion of the hollow portion in the rotational-axis direction, wherein the bending portion is disposed at a position that does not overlap the driving-force transmission unit in the radial direction.

10. The heating device according to claim 5, wherein the filament has a bending portion, and two end portions of the filament are connected to terminals at a second end portion of the hollow portion in the rotational-axis direction, wherein the bending portion is disposed at a position that does not overlap the driving-force transmission unit in the radial direction.

11. The heating device according to claim 6, wherein the filament has a bending portion, and two end portions of the filament are connected to terminals at a second end portion of the hollow portion in the rotational-axis direction, wherein the bending portion is disposed at a position that does not overlap the driving-force transmission unit in the radial direction.

* * * * *